United States Patent [19]

Freissmuth et al.

[11] 4,154,605

[45] May 15, 1979

[54] DESULFURIZATION OF IRON MELTS WITH FINE PARTICULATE MIXTURES CONTAINING ALKALINE EARTH METAL CARBONATES

[75] Inventors: Alfred Freissmuth, Trostberg; Werner Gmoehling, Hufschlag; Heinrich Roeck, Trostberg, all of Fed. Rep. of Germany

[73] Assignee: SKW Trostberg Aktiengesellschaft, Trostberg, Fed. Rep. of Germany

[21] Appl. No.: 881,373

[22] Filed: Mar. 8, 1978

[51] Int. Cl.[2] ..... C22C 33/08

[52] U.S. Cl. ..... 75/58; 75/53

[58] Field of Search ..... 75/53, 58

[56] References Cited

U.S. PATENT DOCUMENTS

| | | | |
|---|---|---|---|
| 2,799,575 | 7/1957 | Tisdale | 75/27 |
| 3,885,957 | 5/1975 | Richter | 75/58 |
| 3,980,469 | 9/1976 | Forster | 75/53 |
| 3,998,625 | 12/1976 | Koros | 75/53 |
| 4,036,635 | 7/1977 | Klapdar | 75/58 |
| 4,040,818 | 8/1977 | Clegg | 75/53 |
| 4,049,442 | 9/1977 | Freissmuth | 75/58 |

*Primary Examiner*—P. D. Rosenberg

*Attorney, Agent, or Firm*—Curtis, Morris & Safford

[57] ABSTRACT

Compositions for desulfurizing iron melts comprised of alkaline earth metal carbonates, such as calcium carbonates, and reductive metals, such as silicon alloys, and a process for desulfurizing iron melts therewith.

19 Claims, No Drawings

DESULFURIZATION OF IRON MELTS WITH FINE PARTICULATE MIXTURES CONTAINING ALKALINE EARTH METAL CARBONATES

This invention relates to fine-grain desulfurizing mixtures for iron melts of alkali-earth carbonates as well as the compositions of same with reductive metals and a method for using the same.

In order to be able to continue to produce high grade iron materials of constant quality, the desulfurization of pig iron and steel is acquiring increasing importance due to the declining quality of the ores and of the reducing agents such as coke and heavy fuel oil.

Naturally occurring carbonates of the alkali-earth metals or carbonates thereof obtained by chemical reaction would be particularly suitable and inexpensive desulfurizing agents. As a result of the large quantities of gases which are produced upon the introduction of fine-particle carbonates into molten iron at temperatures of about 1,200° to 1,700° C., large amounts of iron would, however, be thrown out of the treatment vessels such as a ladle. Because of this disadvantage, namely the non-controllable development of gas, the low-cost, environmentally unobjectionable alkali-earth carbonates, which are available in sufficient quantity in nature, cannot be used directly for the desulfurizing of molten iron.

This is all the more regrettable since, as it is known, the alkali earth oxides freshly formed in accordance with equations (1) and (2) have a very high reactivity due to their small crystal size.

$$CaCO_3 \rightarrow CaO + CO_2 \quad \Delta H_1 = +42.8 \text{ kcal/Mol} \qquad (1)$$

$$MgCO_3 \rightarrow MgO + CO_2 \quad \Delta H_2 = +24.3 \text{ kcal/Mol} \qquad (2)$$

Other disadvantages in the use of alkali-earth carbonates as desulfurizing agents for molten iron result from the endothermic cleavage and carbon dioxide formation (see equations (1) and (2)), whereby the iron melt is considerably cooled. Furthermore, the reaction products produced such as calcium oxide, magnesium oxide, or calcium sulfide, cause a stiffening of the slags present at the surface of the melts, i.e., they increase the melting point of said slags and thus make removal from the treatment vessels more difficult.

In all industrial methods used today for the deacidification of the alkali-earth carbonates, for instance the burning of lime, the dwell time of the resultant alkali-earth oxides at the acidification temperature is comparatively several orders of magnitude longer as against blowing into a pool of iron. Accordingly, industrially calcined lime, calcined dolomite, or calcined magnesite, due to recrystallization of the very small oxide crystallites (originally produced and which form larger crystals) is considerably slower in reaction then the alkali-earth oxides which are freshly formed by deacidification when blowing alkali-earth carbonates into molten iron and when, within one to five seconds, these rise through the melt and react with the sulfur dissolved in the melt.

If the alkali-earth metal carbonates are replaced by the alkali-earth metal oxides produced industrially from them, the disadvantage of a non-controllable development of gas is, it is true, avoided, but the desulfurization effect when alkali-earth oxides are used is unsatisfactory in all the processes which have become known up to now, even when soft-burned alkali-earth oxides are used, since the calcium oxide crystals are too large and therefore too slow to react. Only a part of the alkali-earth oxides reacts with sulfur contained in the iron melt.

It was therefore desired to develop new desulfurizing mixtures for iron melts which, starting from industrially readily accessible products, present in practically unlimited amount, and together with certain additives assure good desulfurization values with high velocity of reaction and scarcely increase the cost of the production of crude steel.

This purpose has been achieved by means of fine particulate desulfurization mixtures based on alkali-earth carbonates, which are characterized by the fact that these contain further metals of reducing action (reductive metals) which bring about the superheating of the highly-active alkali-earth oxide, formed in situ in the iron melt, and suppress the development of gas.

It has been found that in the presence of metals of reducing action, alkali-earth carbonates react exothermically with them at temperatures of about 1,100°–1,300° C. It was surprisingly found that a large quantity of carbon is formed and that scarcely any gas is liberated. A reaction mechanism in accordance with equations (1) to (6) (further shown herein) is thus assured.

When blowing alkali-earth carbonates into iron melt, the dwell time of the alkali-earth oxide formed from the carbonates and of the carbon dioxide produced by thermal dissociation is only a few seconds even immersing a lance to a depth of 2 to 4 meters. The carbon dioxide which develops is removed by exothermal reaction by the addition, in accordance with the invention, of a metal of reductive action. The gas bubble produced collapses immediately and the alkali-earth oxide formed, which is strongly overheated due to the exothermal reaction of the carbon dioxide with the metal, avidly reacts with the sulfur present in the molten iron since no recrystallization or grain growth whatsoever take place during the short time of the ascent to the surface. The formation and collapse of the gas bubbles promote the agitating and mixing of the molten iron.

As alkali-earth carbonates, which may be of a mineral nature or prepared synthetically, calcium carbonate, magnesium carbonate, dolomite as well as half-burned dolomite and diamide lime (calcium diamide carbonate) are in particular used. The latter is the residue obtained upon the production of cyanamide or dicyandiamide from calcium cyanamide and consists essentially of calcium carbonate and graphitic carbon. Upon contact with the molten iron, which has a temperature of at least about 1200° C., these carbonates decompose into calcium oxide and carbon dioxide. The produced calcium oxide is a highly active desulfurizing agent at the time of its production. The cleavage and production of large quantities of carbon dioxide takes place with considerable consumption of heat (see equations (1) and (2)), as a result of which the temperature of the molten iron is reduced.

This reduction in temperature is however more than compensated for by the addition of a metallic reducing agent. The exothermic reaction of the reducing agent — which must be stronger under the given conditions than free carbon or its compounds with hydrogen — with the carbon dioxide split-off from the carbonates exerts a favorable influence on the heat balance, which is affected by the endothermal decomposition of the alkali-earth carbonate (equations (3) and (4)).

$$CO_2 + Si \rightarrow SiO_2 + C \quad \Delta H = -123.7 \text{ kcal/Mol} \quad (3)$$

$$1{,}5\ CO_2 + 2\ Al \rightarrow Al_2O_3 + 1.5\ C \quad \Delta H = -238.9 \text{ kcal/Mol} \quad (3)$$

The reducing agent therefore has the purpose of so binding, by exothermal chemical reaction, the carbon dioxide which is liberated upon the thermal decomposition of the alkali-earth carbonate. Hence, only an intermediate development of gas takes place which, while it agitates the melt, no longer leads to splattering. Moreover, the overall heat balance remains positive and advantageous. Accordingly, the desulfurizing agent which is blown-in is superheated as compared with the melt. A certain residual development of gas is desirable for sufficient mixing of the melt.

Reducing agents which satisfy these conditions are, for instance, silicon, aluminum, alloys of aluminum and silicon, manganese silicon and ferrosilicon having silicon contents of 15 to 98 percent silicon as well as mixtures of the aforementioned substances, powdered metal-containing wastes from metal working or crushing processes, aluminum filings, or dross, etc.

The proportion of such reducing agents in the desulfurizing mixture can amount to up to 90 percent by weight. A content of 5 to 85 percent by weight is preferably used.

Additionally, the reducing agent, when it is oxidized by the carbon monoxide and/or carbon dioxide, should, in addition, form alkali-earth oxide which then also exerts a desulfurizing action.

By way of example, the following reaction equations may be given:

$$CO + Ca \rightarrow CaO + C \quad \Delta H = -125 \text{ kcal/Mol} \quad (5)$$

$$CO_2 + 2\ Mg \rightarrow 2\ MgO + C \quad \Delta H = -193 \text{ kcal/Mol} \quad (6)$$

As reducing agents which satisfy both conditions, mention may be made, by way of example, of calcium silicon, barium-calcium silicon, magnesium ferrosilicon, calcium, magnesium, strontium, barium, alloys of calcium, magnesium, strontium and barium, magnesium calcium silicon, ferrocalcium silicon and aluminum calcium silicon. Mixtures of these and other substances, particularly with iron, can also be used. In order to obtain a sufficient effect, up to 90 percent by weight, and preferably 10 to 25 percent by weight, should be added in the desulfurizing mixture.

Finally, the reducing agent, after its oxidation by carbon dioxide or carbon monoxide, should make a contribution to reducing the melting point of the slags from the desulfurization reaction without the walls of the treatment vessel being more strongly attacked by added fluxes such as fluorospar or colemanite. They must therefore be compounds which are present in the slag covering the melt even before the desulfurizing treatment, for instance, in the case of pig iron, compounds such as silicon dioxide, aluminum oxide, or silicates containing these and other oxides. The reducing agents which satisfy this condition are, for instance, calcium silicide, magnesium ferrosilicon, aluminum calcium silicide, as well as mixtures of said substances and others. Depending on the nature of the slag on the melt prior to the desulfurization treatment, the composition of the reducing agent should be so selected that the slag does not become more viscous during the treatment.

The amount of reducing agent of the aforementioned type in the desulfurizing mixture can amount to up to 90 percent by weight. A percentage of about 10 to 80 percent by weight is preferably added.

All the metallic reducing agents mentioned here may be industrial products and contain the ordinary impurities resulting from their manufacture. No special requirements as to purity are made. In particular, iron may be present as impurity.

The metallic reducing agents used in accordance with the method of the invention therefore fulfill entirely different purposes than the reducing agents contained in desulfurizing mixtures which have been previously described. The latter, as a result of the splitting-off or formation of hydrogen, carbon dioxide, carbon monoxide, or some other gas of reducing action are intended merely to create a protective atmosphere in order to protect the actual desulfurizing agent, such as for instance calcium carbide, from oxidation. In the present invention, the added metallic reducing agents, however, effect a binding, in exothermal reaction, of the carbon dioxide liberated upon the decomposition of the alkali-earth carbonates, and deliver additional active alkali-earth oxides in situ as well as reduce the melting point of the slags. The active, superheated calcium oxide reacts in known manner with the sulfur dissolved in the molten iron, for instance, in accordance with the following equation in case of pig iron:

$$CaO + S \text{ dissolved} + C \text{ dissolved} \rightarrow CaS + CO \quad (7)$$

The calcium sulfide formed in accordance with equation (7) is taken up by the slag floating on the molten iron.

By the use of different metals in the alkali-earth carbonate and in the metallic reducing agent, the melting points of the oxides or oxide mixtures resulting from the desulfurizing mixture can be controlled. In this way it is also possible to control the melting point and the consistency of the slags floating of the molten iron. In addition, the desulfurizing mixtures may also contain certain amounts of fluxes, such as inorganic fluorides or borates.

In order to further increase the exothermal nature of the desulfurizing mixture introduced into the molten iron and thus the superheating of the alkali-earth oxide of desulfurizing action, proportions of known thermite mixtures, consisting of finely granulated iron oxide and powdered aluminum, may also be present.

When using mixtures consisting essentially of calcium carbonate and ferrosilicon, it may prove advisable to add, furthermore, a few percent by weight of a calcium-magnesium or calcium-silicon alloy.

The preparation of such desulfurization mixtures in accordance with the invention can be effected by simply mixing the individual components together in the corresponding ratio. However, it is preferred to grind the components, after intensive drying of the alkali-earth carbonate as lump starting products together with one or more reducing agents and bring these to granular sizes of less than 3 mm and preferably less than 0.3 mm. The particle size of the alkali-earth-carbonate can be coarser than that of the reducing agent, which would be present in very fine particle size. This finely granular mixture of alkali-earth carbonate and reductive metal can be conveyed pneumatically, such as by a gas feed stream, and by means of blast technology customarily used today, is introduced into molten iron present in the hearth of a blast furnace, in an open ladle, or in a transfer ladle, or in mixers. It is particularly advantageous for the reaction of the liberated carbon dioxide with the metal of reductive action that the desulfurizing mixture be introduced as deep as possible into the molten iron by means of the blast lance. The ferrostatic pressure or the additional pressure of the gas atmosphere has an advantageous effect in the sense of accelerating the reaction of the carbon dioxide with the metal.

Should it be desirable instead of producing a mixture of alkali-earth carbonate and metal of reducing action, the individual components can be stored separately, measured out, and pneumatically conveyed separately, and then combined to form a mixture only shortly before the lance or within the lance.

The following examples are intended further to explain the invention, without however limiting it to the mixtures or compositions indicated, their preparation or use.

EXAMPLE 1

Desulfurization of pig iron with a mixture consisting of powdered magnesium and calcium carbonate.

The desulfurizing mixture was prepared by simultaneous grinding of limestone, which had been precrushed to 0 to 5 mm, with powdered magnesium of a particle size of less than 1 mm in a tube mill using nitrogen as blanket gas.

203 tons of pig iron were treated in a transfer ladle of a capacity of 230 tons with the mixture of 40 percent by weight powdered magnesium and 60 percent by weight ground limestone, the mixture being blown into the melt with an immersion lance (gas lance) at a depth of 1.85 m, with argon as conveyor or blast gas.

The molten iron had a temperature of 1310° C. The rate of conveyance was throttled until no substantial flame of burning magnesium could be noted any longer on the surface. This was obtained with an introduction rate of 17 kg per minute.

The molten pig iron had an initial sulfur content of $S_I = 0.042$ percent. After a period of treatment of 11 minutes, 198 kg of desulfurizing agent had been blown-in. This corresponds to 0.98 kg per ton of pig iron. The sulfur content after the treatment was $S_E = 0.005$ percent.

Thus, by calculation, there is a degree of conversion for calcium oxide formed from the calcium carbonate into calcium sulfide, for the magnesium oxide newly formed in the reaction into magnesium sulfide, and for the magnesium present (in excess) into magnesium sulfide, of a total of 46 percent.

EXAMPLE 2

Desulfurization of a molten steel with a mixture of calcium carbonate, calcium silicide (calcium silicon) and aluminum.

The molten steel which was at a temperature of 1620° C. contained:

0.07 percent by weight carbon
0.13 percent by weight silicon
0.35 percent by weight manganese as well as sulfur from 0.024 to 0.033 percent by weight, which was to be reduced by the desulfurization treatment on the average to 0.005 percent by weight.

In order to avoid the oxidizing influence on the molten steel, a desulfurizing mixture having a deficit of calcium carbonate was selected. The small addition of aluminum present was intended to assure the desired aluminum content in the steel and, by partial reaction with calcium carbonate, to introduce aluminum oxide into the slag.

In combination with a low-oxide, fluorspar-containing slag blanket, a desulfurizing mixture consisting of 37 percent by weight calcium carbonate
60 percent by weight calcium silicon
3 percent by weight aluminum was introduced pneumatically into the molten steel contained in a 70-ton ladle. As conveyor or blast gas 6 to 10 liters of argon per kilogram of desulfurization mixture were used. The following table shows the results of the individual treatments:

| Treatment Number | $S_I$ | $S_E$ | $\Delta S$ | Consumption kg/t |
|---|---|---|---|---|
| 1 | 0.031 | 0.005 | 0.026 | 2.4 |
| 2 | 0.027 | 0.003 | 0.024 | 2.4 |
| 3 | 0.030 | 0.002 | 0.028 | 2.7 |
| 4 | 0.019 | 0.003 | 0.016 | 2.1 |
| 5 | 0.013 | 0.002 | 0.011 | 2.0 |
| 6 | 0.016 | 0.002 | 0.014 | 2.1 |
| 7 | 0.033 | 0.008 | 0.025 | 2.2 |
| 8 | 0.032 | 0.011 | 0.021 | 1.8 |

The consumption of an average of 2.2 kg of desulfurizing mixture per ton of steel means a 50–65 percent better utilization of the desulfurizing agent than obtained with the previously customarily employed mixtures.

EXAMPLE 3

Desulfurization of pig iron with a mixture consisting of powdered calcium silicide and calcium carbonate. A mixture was prepared from 28.6 percent industrial calcium silicide (calcium silicon) and 71.4 percent calcium carbonate. The industrial calcium silicide contained 30.1 percent calcium and 60.3 percent silicon. The calcium carbonate was a precipitated product, prepared synthetically. The mixture was produced in a three-chamber tube mill. The fineness of grain of the mixture of the industrial calcium silicide and calcium carbonate leaving the mill was 98 percent less than 0.1 mm. With this mixture, 196 tons of pig iron were treated in the transfer ladle. Air was used as blast gas.

The charge was 12 liters of air (STP) per kilogram of mixture. 325 kg of the above-designated mixture were blown-in within 9.5 minutes.

Before the treatment, the sulfur content was 0.047 percent and after the treatment it was 0.013 percent. Therefore 0.034 percent sulfur was removed, corresponding to a degree of desulfurization of 72 percent. The yield of the conversion of the desulfurizing agent into calcium sulfide, referred to the total content of calcium, was 59.8 percent. The consumption of desulfurizing agent was 0.5 kg/ton of pig iron per 0.01 percent sulfur removed.

What is claimed is:

1. In the process of desulfurizing of iron melts, the improvement comprising:

(a) introducing in said iron melt a mixture containing finely divided particulate of alkali earth metal carbonate and a reductive metal;

(b) forming in-situ a highly active alkali earth metal oxide, while maintaining therewith reductively active metals;

(c) suppressing formation of gases in said melt, during said particulate introduction and in-situ reaction, and (d) desulfurizing said melt with said particulate so introduced or the reaction product of said particulate obtained as in step (b).

2. The process as defined in claim 1 including a lowering of the melting point of the slag, associated with said iron melt, by the oxidation product of said reductive metal compositions, after the oxidation of the same in said melt.

3. The process as defined in claim 1, wherein the alkali earth metal carbonate comprises calcium carbonate, magnesium carbonate, dolomite, calcium diamide carbonate, or mixtures of the same.

4. The process as defined in claim 1 wherein the reductive metal comprises calcium, silicon, aluminum, magnesium, mixtures of same, or alloys thereof, including same with impurities of iron, manganese, or chromium.

5. The process as defined in claim 1 wherein the reductive metal composition comprises as an alloy of silicon, calcium silicon, calcium magnesium silicon, ferrosilicon, manganese silicon, ferromagnesium silicon, and aluminum calcium silicon.

6. The process as defined in claim 1 wherein the reductive metal is an alloy of calcium and magnesium.

7. The process as defined in claim 1 wherein a carbonate and reductive metal composition is from 20 to 80 percent by weight of carbonate and the reductive metal is from 80 to 20 percent by weight, with respect to said composition.

8. The process as defined in claim 1 wherein the carbonate and reductive metal combination is from 30 to 70 percent by weight calcium carbonate and 70 to 30 percent by weight of silicon.

9. The process as defined in claim 1 wherein the carbonate and reductive metal combination is an alkali earth metal carbonate of 30 to 70 percent by weight and the reductive metal is 70 to 30 percent by weight and is ferromagnesium silicon.

10. The process as defined in claim 1 wherein the carbonate and reductive metal combination is 35 to 70 percent by weight of calcium diamide carbonate and 65 to 30 percent by weight of ferromagnesium silicon.

11. The process as defined in claim 1 wherein the fine particulate material is introduced into a melt with a gas blast.

12. The process as defined in claim 11 wherein the carbonate and the reductive metal is separately fed into a gas lance, by a gas feed stream, and admixed before introduction in said lance or thereafter, and said lance is inserted in said iron melt for introduction of said carbonate and said reductive metal as particulates therein.

13. An iron melt desulfurizing composition consisting essentially of 20 to 80 percent by weight of an alkali earth metal carbonate and 80 to 20 percent by weight of said composition reductive metal, in a particle size less than 3 mm.

14. The composition as defined in claim 13, wherein the alkali earth metal carbonate is calcium carbonate, magnesium carbonate, dolomite, calcium diamide carbonate, or mixtures of same.

15. The composition as defined in claim 13, wherein the reductive metal composition is calcium, silicon, aluminum, magnesium, mixtures of same, or alloys thereof including same with impurities of iron, manganese, or chromium.

16. The composition as defined in claim 13, wherein the reductive metal is an alloy of silicon and the same is calcium silicon, calcium magnesium silicon, ferrosilicon, manganese silicon, ferromagnesium silicon, and aluminum calcium silicon.

17. The composition as defined in claim 13 wherein the reductive metal is an alloy of calcium and magnesium.

18. The composition as defined in claim 13 wherein the carbonate and reductive metal combination is an alkali earth metal carbonate of 30 to 70 percent by weight and the reductive metal is 70 to 30 percent by weight and is silicon or ferromagnesium silicon.

19. The composition as defined in claim 18 wherein the alkali earth metal carbonate is calcium diamide carbonate.

* * * * *